US007059306B2

(12) United States Patent
Reddy

(10) Patent No.: US 7,059,306 B2
(45) Date of Patent: Jun. 13, 2006

(54) METHOD AND SYSTEM OF EVAPORATIVE EMISSION CONTROL FOR HYBRID VEHICLE USING ACTIVATED CARBON FIBERS

(75) Inventor: Sam R Reddy, West Bloomfield, MI (US)

(73) Assignee: General Motors Corporation, Detroit, MI (US)

( * ) Notice: Subject to any disclaimer, the term of this patent is extended or adjusted under 35 U.S.C. 154(b) by 234 days.

(21) Appl. No.: 10/720,818

(22) Filed: Nov. 24, 2003

(65) Prior Publication Data

US 2005/0109327 A1 May 26, 2005

(51) Int. Cl.
*F02M 37/04* (2006.01)

(52) U.S. Cl. ..... 123/518; 123/519; 123/520

(58) Field of Classification Search ..... 123/516–520
See application file for complete search history.

(56) References Cited

U.S. PATENT DOCUMENTS 3,650,102 A 3/1972 Economy et al.
3,723,588 A 3/1973 Economy et al.
RE35,181 E * 3/1996 Hudz ..... 261/142
6,279,548 B1 8/2001 Reddy
6,463,889 B1 * 10/2002 Reddy ..... 123/3
6,769,415 B1 * 8/2004 Reddy et al. ..... 123/519
6,843,236 B1 * 1/2005 Shetley ..... 123/525
2004/0094132 A1 * 5/2004 Fujimoto et al. ..... 123/519

OTHER PUBLICATIONS

U.S. Appl. No. 10/151,430, "Evaporate Control System."
K. L. Foster et al., "Adsorption Characteristics of Trace Volatile Organic Compound In Gas Streams Onto Activated Carbon Fibers," Chem. Mater., vol. 4, pp. 1068-1073 (1992).
H. Itakura et al., "Studies on Carbon Canisters to Satisfy LEVII EVAP Regulations," SAE Paper No. 2000-01-0895, (2000), pp. 1-9.
Joseph S. Hayes, Jr., "Activated Carbon Fiber Textiles for Filtration and Separation," Brochure of American Kynol, Inc., undated.
P. D. Sullivan, et al., "Adsorption and Electrothermal Desorption of Hazardous Organic Vapors," J. Environmental Eng., Mar. 2001, pp. 217-223.

* cited by examiner

*Primary Examiner*—Thomas Moulis
(74) *Attorney, Agent, or Firm*—Kathryn A. Marra

(57) ABSTRACT

An evaporative emission control system for a hybrid vehicle comprises a scrubber containing an activated carbon fiber material selected to adsorb butane and/or pentane isomer vapors in low concentrations in air passing through the scrubber and apparatus for resistive heating of the activated carbon fiber material to help desorb the adsorbed butane and/or pentane isomers during a period when the internal combustion engine is operating for combustion of the desorbed vapor in the engine. The fibers are conductive and heat by resistive heating when electric current is passed through the fibers by the apparatus.

13 Claims, 5 Drawing Sheets

METHOD AND SYSTEM OF EVAPORATIVE EMISSION CONTROL FOR HYBRID VEHICLE USING ACTIVATED CARBON FIBERS

FIELD OF THE INVENTION

The present invention relates to methods and systems for evaporative emission control for hybrid vehicles, and more specifically to methods and systems for reducing and preventing vapor emissions from fuel tanks of such vehicles.

BACKGROUND OF THE INVENTION

Gasoline typically includes a mixture of hydrocarbons ranging from higher volatility butanes ($C_4$) to lower volatility $C_8$ to $C_{10}$ hydrocarbons. When vapor pressure increases in the fuel tank due to conditions such as higher ambient temperature or displacement of vapor during filling of the tank, fuel vapor flows through openings in the fuel tank. To prevent fuel vapor loss into the atmosphere, the fuel tank is vented into a canister that contains an adsorbent material such as activated carbon granules ("evap" canister).

The fuel vapor is a mixture of the gasoline vapor (referred to in this description also by its main component, hydrocarbon vapor) and air. As the fuel vapor enters an inlet of the canister, the hydrocarbon vapor is adsorbed onto activated carbon granules and the air escapes into the atmosphere. The size of the canister and the volume of the adsorbent activated carbon are selected to accommodate the expected gasoline vapor generation. After the engine is started, the control system uses engine intake vacuum to draw air through the adsorbent to desorb the fuel. The desorbed fuel vapor is directed into an air induction system of the engine as a secondary air/fuel mixture. One exemplary evaporative control system is described in U.S. Pat. No. 6,279,548 to Reddy, which is hereby incorporated by reference.

When the gasoline tank is filled, fuel vapor accumulates in the canister. The initial loading may be at the inlet end of the canister, but over time the fuel vapor is gradually distributed along the entire bed of the adsorbent material. After the engine is started, a purge valve is opened and air is drawn through the canister. The air removes fuel vapor that is stored in the adsorbent material.

One problem encountered by such a system has been vapor breakthrough, or hydrocarbon emissions from the vented vapor adsorption canister, which is often referred to as canister bleed emissions. Such bleed emissions may be, for example, about 20 mg hydrocarbons per day. Co-pending U.S. patent application Ser. No. 10/303,556 describes a method and system for evaporative emission control in which such bleed emissions are adsorbed by activated carbon fibers. The system may be used in a conventional automotive vehicle having an internal combustion engine or in a hybrid vehicle that includes both an internal combustion engine and an electric motor. The activated carbon fiber material can desorb the adsorbed hydrocarbons when purged with air without being heated.

In a hybrid vehicle, however, the internal combustion engine is turned off nearly half of the time during vehicle operation. Because the purging takes place only during operation of the internal combustion engine when the desorbed vapor can be consumed in engine combustion, the evap canister purging with fresh air occurs less than half of the time in a hybrid vehicle. A hybrid vehicle generates nearly the same amount of evaporative fuel vapor as does a conventional vehicle, however, with the result that the lower purge rate of the hybrid vehicle is not sufficient to clean the adsorbed fuel out of the evap canister, resulting in higher evaporative bleed or breakthrough emissions. FIG. 1 demonstrates the difference in bleed emissions, using air purging in a conventional vehicle with only an internal combustion engine and in a hybrid vehicle. With only half the air purge rate, the hybrid vehicle had an unacceptable 27 mg of bleed emissions while the conventional vehicle had only 4 mg of bleed emissions using the system for evaporative emission control of co-pending U.S. patent application Ser. No. 10/303,556. It would thus be desirable to modify this system for use in a hybrid vehicle to reduce bleed emissions.

SUMMARY OF THE INVENTION

The evaporative emission control system for a hybrid vehicle includes a fuel tank for storing a volatile fuel, an internal combustion engine having an air induction system, a primary canister containing activated carbon granules as hydrocarbon adsorbent, a vapor inlet coupled to the fuel tank, a purge outlet coupled to the air induction system, and a vent/air inlet. The primary canister contains the adsorbent activated carbon granules in one or more chambers through which the fuel vapor passes between the vapor inlet and the vent/air inlet. The evaporative emission control system further includes an activated carbon fiber material contained in a scrubber coupled to the vent/air inlet of the primary canister. The activated carbon fiber material lies between and in contact with electrodes of an electrically conductive material, such as plates of copper or steel. The electrodes are in a circuit that can opened or closed, the circuit further including the vehicle's battery (generally a 12-volt battery). When the circuit is closed, current passes from one electrode through the activated carbon fiber material to the other electrode. Due to resistance, the current heats up the activated carbon fiber material. Thus, when current is passed between the plates through the carbon fiber, the fiber acts as a resistive heater.

The activated carbon material adsorbs fuel vapors when the internal combustion engine is not operating to reduce bleed emissions. The circuit containing the battery, the electrodes, and the activated carbon fiber material is then closed for a time sufficient to heat the activated carbon fiber material to a desired temperature by resistive heating due to the electric current passing through the activated carbon fiber material. Intake vacuum then draws air through the scrubber and carries desorbed fuel vapors into the engine for combustion while the internal combustion engine is running. The desorption regenerates the adsorptive capacity of the activated carbon fiber. The activated carbon fiber material is selected to adsorb butane and/or pentane isomer vapors that are in low concentrations in the air. The activated carbon fiber is capable of adsorbing butane and/or pentane isomers in lower concentrations than can the activated carbon granules of the primary canister, while the activated carbon granules may be capable of adsorbing higher amounts of hydrocarbons overall, particularly when the hydrocarbons are more concentrated in the fuel vapor from the fuel tank.

In still other features, the evaporative emissions control system for a hybrid vehicle uses activated carbon granules that may be derived from wood and activated carbon fiber material derived from phenolic fibers, particularly novoloid fibers. The activated carbon fiber material may be in the form of an activated carbon fiber felt or mat, and may be rolled with a sheet of coarse foam (e.g., urethane foam) to reduce pressure drop through the scrubber. In certain embodiments, the evaporative control system may reduce bleed emissions to below 3 mg/day, particularly below 2.0 mg/day.

In a further embodiment, the evaporative emissions control system for a hybrid vehicle uses as the activated carbon fiber an activated carbon fiber material having an average fiber diameter from about 8 to about 10 microns and having an average pore diameter of up to about 20 Angstroms.

The method for evaporative emission control for a fuel tank of a hybrid vehicle in which vapors from the fuel tank are first exposed to a quantity of activated carbon granules, and then any hydrocarbon vapors not adsorbed by the activated carbon granules ("bleed emissions") are passed through a scrubber containing an activated carbon fiber material capable of adsorbing substantially all of the butane and pentane isomer contained in low concentrations in the air of the bleed emissions so that emissions from the fuel tank are reduced to less than about 3 mg per day. The activated carbon fiber material is heated by resistive heat and desorbs the adsorbed hydrocarbons when purged with air. The purge air containing the desorbed hydrocarbons is passed to an internal combustion engine during operation of the internal combustion engine, where the desorbed hydrocarbons are combusted.

In one embodiment of the method, the activated carbon fiber material of the scrubber is first heated to a desired temperature or for a desired period of time by passing a current through the material, then purged, during operation of the internal combustion engine, with intake air for a desired period of time with or without current being passed through the material.

In another embodiment of the method, the activated carbon fiber material of the scrubber is periodically heated for a desired period of time by passing a current through the material without purge air passing through the material during purging of the scrubber while the internal combustion engine is operating.

In the evaporative emission control system for a hybrid vehicle, evaporative emissions from the fuel tank first pass through activated carbon granules and then through activated carbon fiber material. The activated carbon granules adsorb higher concentrations of fuel vapor, while the carbon fiber material adsorbs the bleed emissions that are mainly butanes and pentanes, typically at very low concentrations (1 to 10,000 parts per million by volume in air). The carbon fiber material is heated to a desired temperature or for a desired time by passing current through the material. Intake air is then drawn through the carbon fiber material during operation of the internal combustion engine to carry desorbed bleed emissions to the engine for combustion.

"About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art through this ordinary meaning, then "about" as used herein indicates a possible variation of up to 5% in the value.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
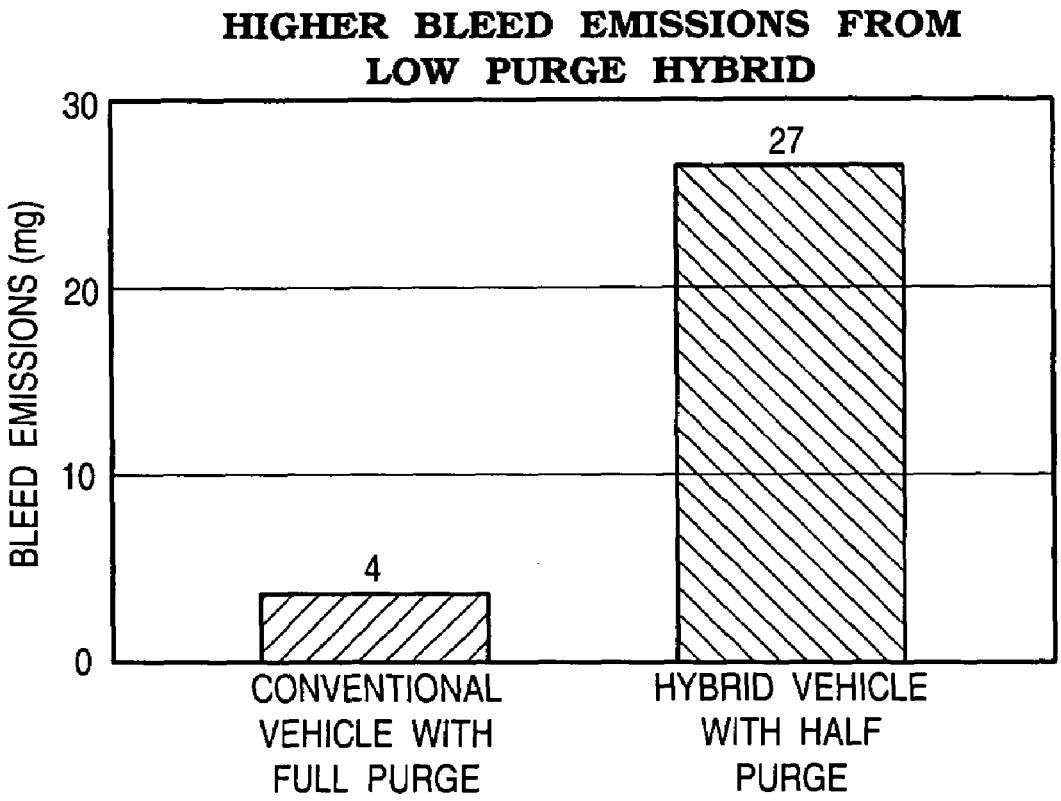
FIG. 1 is a bar chart comparing bleed emissions from a primary canister with scrubber for a conventional vehicle with full purge and from a hybrid vehicle in which purging is carried out only when the internal combustion engine is operating which is about half of the time the vehicle is in operation.
Figure 2:
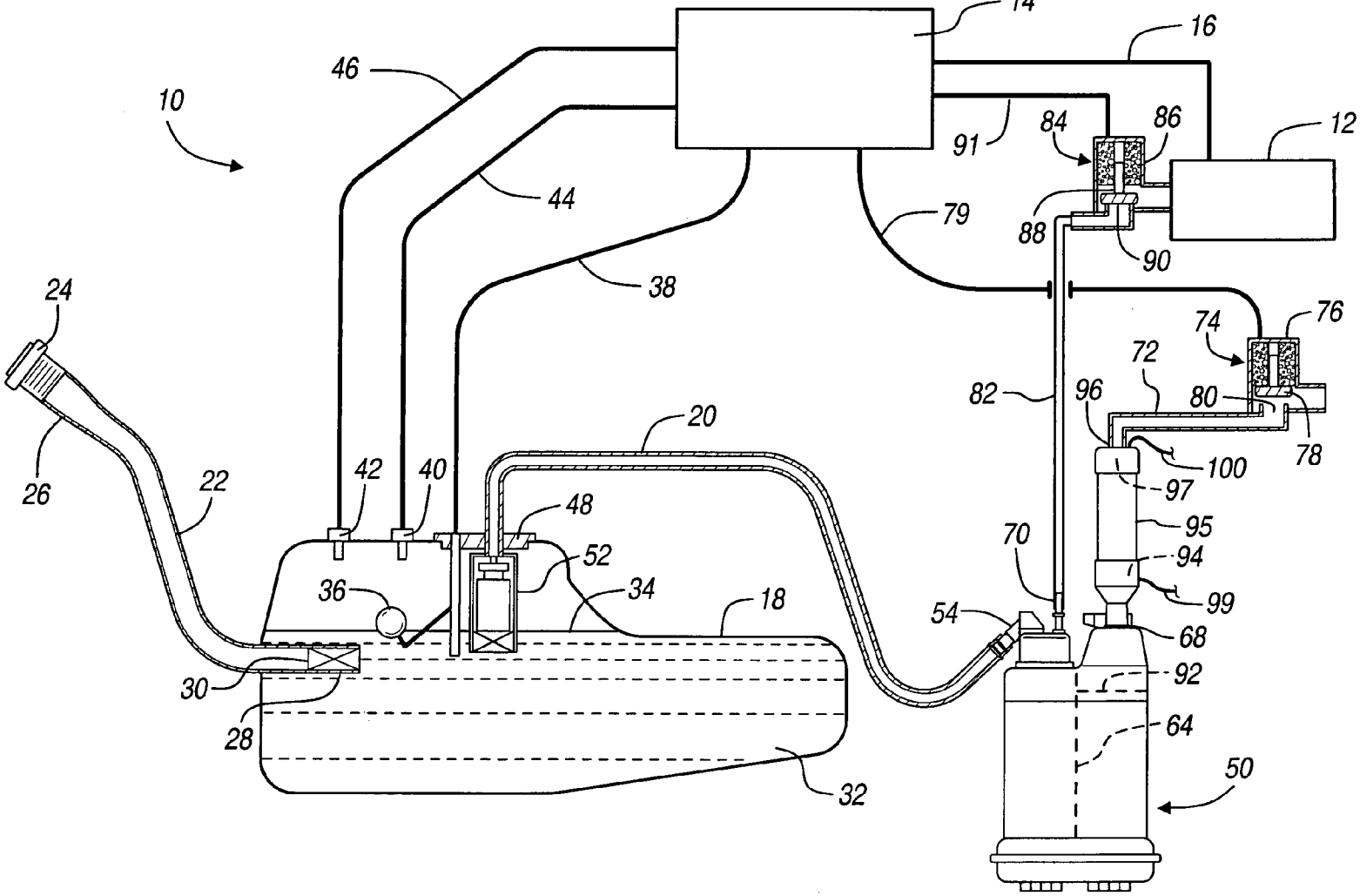
FIG. 2 is a functional block diagram of an evaporative control system for a hybrid vehicle having a primary canister and a separate scrubber.
Figure 3:
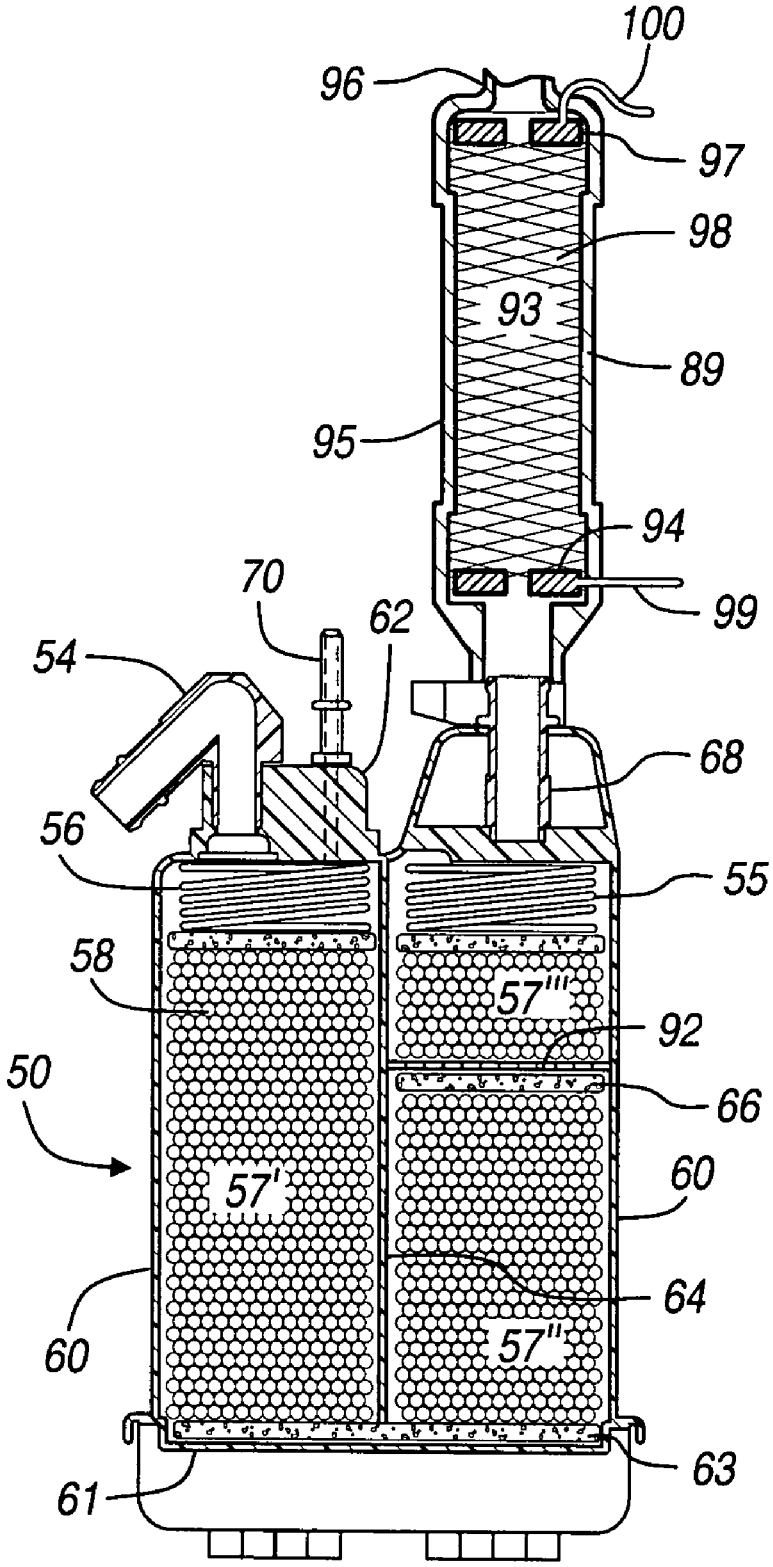
FIG. 3 is a cross sectional view of a primary canister with three chambers containing activated carbon granules and a separate scrubber containing activated carbon fiber material according to the present invention.

Referring now to FIGS. 2 and 3, an evaporative control system 10 for a hybrid vehicle including an internal combustion engine 12 and an electric motor (not shown) is illustrated. Hybrid vehicles combine a gasoline fueled internal combustion (IC) engine and an electric motor to provide a hybrid powertrain with improved fuel economy. Frequent on-off engine operation results in much smaller canister purge air volume. Because the IC engine does not operate nearly 50% of the time, canister purging with fresh air occurs less than 50% of the time during vehicle operation. The internal combustion engine 12 is preferably controlled by a controller 14. The engine 12 typically burns gasoline, ethanol, and other volatile hydrocarbon-based fuels. The controller 14 may be a separate controller or may form part of an engine control module (ECM), a powertrain control module (PCM) or any other vehicle controller.

When the internal combustion engine 12 is started, the controller 14 receives signals from one or more engine sensors, transmission control devices, and/or emissions control devices. Line 16 from the engine 12 to the controller 14 schematically depicts the flow of sensor signals. During operation of the internal combustion, gasoline is delivered from a fuel tank 18 by a fuel pump (not shown) through a fuel line (not shown) to a fuel rail. Fuel injectors inject gasoline into cylinders of the internal combustion engine 12 or to ports that supply groups of cylinders. The timing and operation of the fuel injectors and the amount of fuel injected are managed by the controller 14.

The fuel tank 18 is typically a closed container except for a vent line 20. The fuel tank 18 is often made of blow molded, high density polyethylene provided with one or more gasoline impermeable interior layer(s). The fuel tank 18 is connected to a fill tube 22. A gas cap 24 closes a gas fill end 26 of the fill tube 22. The outlet end 28 of the fill tube 22 is located inside of the fuel tank 18. A one-way valve 30 prevents gasoline 32 from splashing out of the fill tube 22. An upper surface of the gasoline is identified at 34. A float-type fuel level indicator 36 provides a fuel level signal at 38 to the controller 14. A pressure sensor 40 and a temperature sensor 42 optionally provide pressure and temperature signals 44 and 46 to the controller 14.

The fuel tank 18 includes a vent line 20 that extends from a seal 48 on the fuel tank 18 to a primary canister 50. A float valve 52 within the fuel tank 18 prevents liquid gasoline from entering the vapor vent line 20. Fuel vapor pressure increases as the temperature of the gasoline increases. Vapor flows under pressure through the vent line 20 to the vapor inlet of the primary canister 50. The vapor enters canister vapor inlet 54, flows past a retainer element 56 as shown in the figures, and diffuses into chambers containing activated carbon granules 58. Retainer element 56 is shown as a spring pressing against a porous pad that allows the vapor to pass through to the chambers.

The primary canister 50 is formed of any suitable material. For example, molded thermoplastic polymers such as nylon are typically used. The primary canister 50 includes side walls 60, a bottom 61, and a top 62 that define an internal volume. A vertical internal wall 64 extends downwardly from the top 62. A vent opening 68 at the top 62 serves as an inlet for the flow of air past a retainer element 55, shown as comprising a porous, spring loaded element as was retainer element 56, during purging of adsorbed fuel vapor from the activated carbon granules 58. The retaining element 55 may also be located at the bottom of the chamber of activated carbon granules 58, or at both bottom and top. A purge outlet 70 is also formed in the top 62. A stream of purge air and fuel vapor exit the canister through the purge outlet 70 during purging.

A scrubber 95 containing activated carbon fiber material is coupled to vent opening 68. The scrubber may be made of any suitable material, such as molded thermoplastic polymers such as nylon or polycarbonate. Air leaving the primary canister flows through the scrubber. The activated carbon fiber material adsorbs emissions contained in the air, particularly low concentrations of lower molecular weight hydrocarbons such as isomers of butane and/or pentane. The activated carbon fiber material may be in the form of an activated carbon fiber felt or mat, and may be rolled with a sheet of coarse foam (e.g., urethane foam) to reduce pressure drop through the scrubber. At the other end from the primary canister, scrubber 95 is connected through vent opening 96 to a vent line 72 and solenoid actuated vent valve 74. The vent valve 74 is normally open as shown. A solenoid 76 moves a stopper 78 to cover the vent opening 80. The solenoid 76 is actuated by the controller 14 through a signal lead 79. The vent valve 74 is usually closed for diagnostic purposes only.

Scrubber 95 contains upper conductive plate 97 and lower conductive plate 94. The conductive plates may be formed from any electrically conductive material, such as, for example and without limitation, copper or stainless steel. The conductive plates are adjacent to the activated carbon fiber material at either end of scrubber 95. Electric wires 99 and 100 connect, through a circuit (not shown) to opposite poles of a battery, such as the vehicle battery (generally a 12-volt battery). When the circuit is closed, current flows between plates 94 and 97, through the activated carbon fiber material, heating the activated carbon fiber material through resistive heating. Outer shell 89 of scrubber 95 is formed of an electrically nonconductive material.

Figure 4:
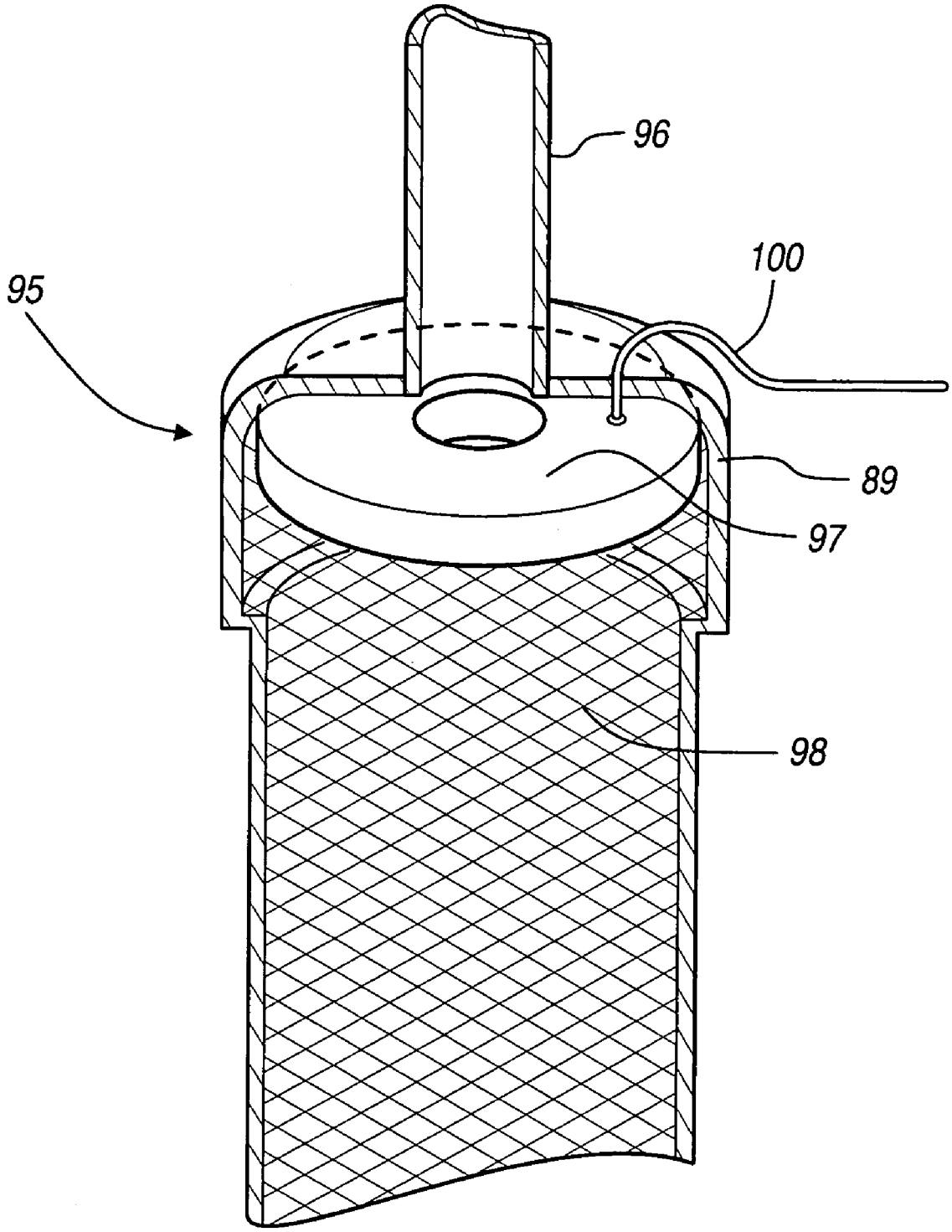
FIG. 4 is a partial cut-away view of an upper portion of a scrubber containing activated carbon fiber material according to the present invention.

FIG. 4 is a partial cut-away view of an upper portion of scrubber 95 having outer shell 89 of electrically nonconductive material containing activated carbon fiber material 98. Upper conductive plate 97 is adjacent to activated carbon fiber material 98 and is connected by upper wire 100 to an electric circuit containing a battery, such as the vehicle's battery. An opening in upper conductive plate 97 allows air to pass through vent opening 96.

Referring again to FIGS. 2 and 3, the purge outlet 70 is connected by a purge line 82 through a solenoid actuated purge valve 84 to the internal combustion engine 12. The purge valve 84 includes a solenoid 86 and a stopper 88 that selectively close an opening 90. Purge valve 84 is operated by the controller 14 through a signal lead 91 when the internal combustion engine 12 is running and can accommodate a secondary air/fuel mixture.

As an air/fuel mixture flows from the fuel tank 18 through the vent line 20 and the inlet 54 into the primary canister 50, hydrocarbons from the vapor are adsorbed by the activated carbon granules 58 in the primary canister 50. FIG. 3 shows a primary canister containing three separate chambers of activated carbon granules defined by walls 64 and 92, the chambers containing volumes 57', 57", and 57'" of activated carbon granules. Wall 64 extends to a layer 63 of porous material that contains the activated carbon granules but allows the vapor to flow from one chamber to the next. Wall 92 is porous to allow vapor to pass through and is shown together with a layer 66 of porous material. Layers 63 and 66 may be, for example, foam plastic pads that are porous to the vapor while retaining the activated carbon granules in their respective chambers. Wall 92 may be made of a stiffer material, for example a steel mesh or a plastic screen. The vapor passes through all chambers of the activated carbon granules 58, with the air exiting through the vent opening 68. Lower molecular weight hydrocarbons, such as butanes and pentanes, due to being smaller in size and more volatile, may be lost as bleed emissions. The air and bleed emissions exiting through vent opening 68 pass through the separate scrubber 95 containing a volume 93 of an activated carbon fiber material 98, where the bleed emissions are adsorbed by activated carbon fiber material 98.

Before or during operation of the hybrid vehicle's internal combustion engine 12, the circuit containing plates 94 and 97 is closed and current passes through activated carbon fiber material 98 for a desired time heating the activated carbon fiber material 98 to a desired temperature. When activated carbon fiber material 98 has been heated for a desired time or to a desired temperature, and while internal combustion engine 12 is operating, purge air is drawn through scrubber 95 to draw desorbed vapor into engine 12 for combustion. During purging, controller 14 opens the purge valve 84 to allow air to be drawn past the vent valve 74. The air flows through the vent line 72, scrubber 95, and into the vent opening inlet 68. The air is drawn through the scrubber and evap canister. In other words, air flows through the activated carbon fiber material and the activated carbon granules. The air becomes laden with desorbed hydrocarbons and exits through the purge outlet 70. The adsorbed hydrocarbons are desorbed from the heated activated carbon fiber material. The fuel-laden air is drawn through the purge line 82 and the purge valve 84 into the engine 12.

Figure 5:
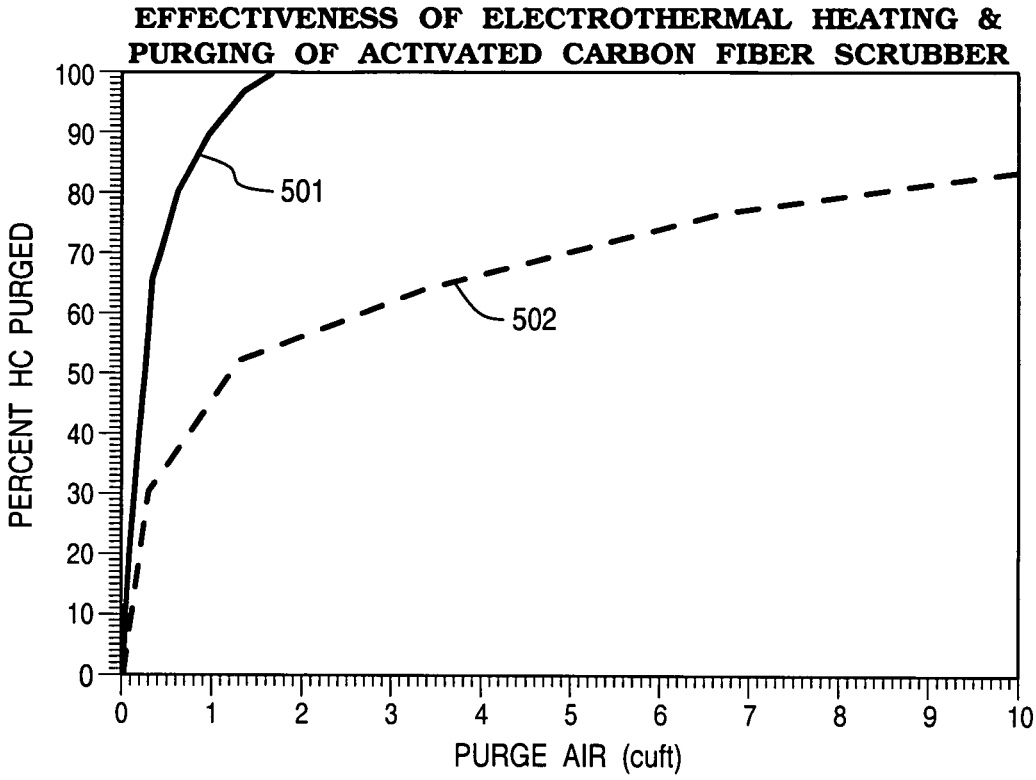
FIG. 5 is a graph of percent hydrocarbon vapor purged from a scrubber comparing purging with and without a period of initial heating.

FIG. 5 illustrates the effectiveness of electrothermal heating of the activated carbon fiber material before applying purge air. Curve 501 is the result of repeated cycles of three minutes electrothermal heating of the activated carbon fiber material, followed by three minutes of purge air at a flow rate of 20 cubic feet per hour. 100 percent of the adsorbed hydrocarbon was purged from the activated carbon fiber with about 1.4 cubic feet of purge air. Curve 502 is the result of passing purge air at a flow rate of 20 cubic feet per hour, without heating, through the activated carbon fiber material. Even after 10 cubic feet of purge air has passed through the activated carbon fiber material, only about 80 percent of the adsorbed hydrocarbon was purged.

Figure 6:
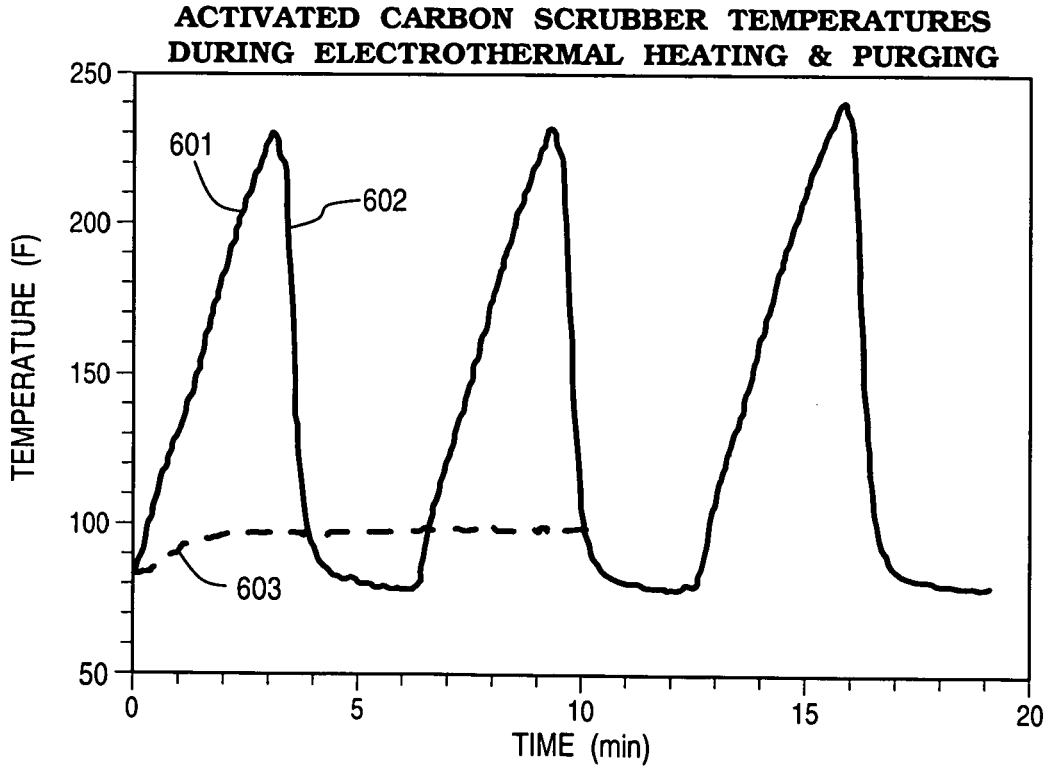
FIG. 6 is a graph comparing the temperature of the carbon fiber material of the scrubber if heated periodically without purge air and if purging and heating are carried out simultaneously.

FIG. 6 illustrates the temperature profile during the repeated cycles of three minutes electrothermal heating of the activated carbon fiber material, followed by three minutes of purge air at a flow rate of 20 cubic feet per hour. Section 601 of the upper curve shows that during three minutes of electrothermal heating, with no purge air flowing, the activated carbon fiber material was heated to about 230° F. Following that, purge air was passed through the activated carbon fiber material at a flow rate of 20 cubic feet per hour for three minutes without heating. Section 602 of the upper curve shows that the purge air cooled the activated carbon fiber substantially. The temperature profile was substantially repeated through further cycles of three minutes of heating and three minutes of purge air flow. Lower curve 603, on the other hand, shows the temperature profile while heating was carried out during purge air flow at a rate of 20 cubic feet per hour. The temperature rose to about 100° F., where it was maintained. While it is expected that hydrocarbon vapor could be desorbed and removed by the purging air at a faster rate at 100° F. than at ambient without heating, it can be seen that the cycling of period of heating and purge air of the upper curve will be still more effective in quickly purging the scrubber during the limited operation of the internal combustion engine in a hybrid vehicle.

One suitable example of the activated carbon granules is wood based activated carbon granules. For example, Westvaco wood carbon NUCHAR BAX-1500 is commercially available. Other activated carbon granules that are currently used in conventional canisters are also contemplated.

The bleed emissions from the primary canister primarily consist of butane and pentane isomers at very low concentrations, including butane, pentane, isobutane, and isopentane. The present invention utilizes an activated carbon fiber material in the scrubber that is particularly suited to adsorb these light hydrocarbons at very low concentrations. The activated carbon granules that are typically used in current production canisters are not suitable for adsorbing these light hydrocarbons because, while the activated carbon granules may be able to adsorb an overall higher amount of hydrocarbons, they are not as able to adsorb small-molecule hydrocarbons such as the butane and pentane vapors of bleed emissions efficiently at low concentrations. The activated carbon fiber material preferably has an average pore diameter of about 20 Angstroms or less. Substantially all of the pores should have diameters of about 25 Angstroms or less, and preferably virtually all of the pores have a pore diameter of about 22 Angstroms or less. In one embodiment, the activated carbon of the second adsorbent has predominantly, preferably substantially entirely, pore diameters of from 14 to 22 Angstroms. While higher pore diameters are generally thought to have greater capacity for adsorbing materials, pore diameters higher than about 25 Angstroms do not efficiently adsorb the butane and pentane isomers of bleed emissions.

The scrubber preferably contains about 5 to about 10 grams, preferably, from about 6 to about 10 grams of activated carbon fiber, and more preferably from about 7 to about 10 grams of activated carbon fiber material, in suitable form. A hybrid vehicle preferably uses from about 6 to about 10 grams of the activated carbon fiber, more preferably from about 8 to about 10 grams of the activated carbon fiber. The activated carbon fiber material may be employed in different forms, including, without limitation, rovings, yarns, and chopped fibers, and other forms derived from fibers, including felts, papers, and woven and nonwoven fabrics. The form or combinations of forms of the fiber material are selected to prevent excessive pressure drops that would affect the engine or evaporative emission control system performance.

In another embodiment, the activated carbon fiber is derived from phenolic fibers, preferably novoloid fibers. The term "novoloid" designates fibers having a content of at least 85 weight percent of a crosslinked novolac. In general, phenolic resins are prepared by reaction of phenol or substituted phenols with an aldehyde, especially formaldehyde, although other aldehydes, such as acetaldehyde or crotonaldehyde, may be used or used in mixture with formaldehyde. The reaction is generally carried out with an acidic or basic catalyst. The phenolic resin is formed into a fiber. Novoloid fibers may be prepared by acid-catalyzed crosslinking of meltspun novolac resins in aqueous formaldehyde to produce crosslinked, amorphous network. Preferred processes for manufacturing novoloid fibers are disclosed in Economy et al, U.S. Pat. Nos. 3,650,102 and 3,723,588, both of which are entirely incorporated herein by reference. Other suitable crosslinkers include polyamines crosslinkers.

The preferred novoloid fibers may be in any form desired, including continuous fibers, chopped fibers, fibers carded to produce a fluffy web or wool, a fluffy web needled to obtain a felt, or fibers twisted into a roving, formed into a yarn, woven into a cloth, or formed into a paper with a binder such as a cellulosic material. The novoloid fibers are carbonized and activated to produce activated carbon forms. In a representative method, the fibers may be pyrolyzed at about 800–1000° C. in the presence of an "activating" gas such as carbon dioxide or water vapor, or in an inert atmosphere (e.g., in nitrogen) followed by a later activating step to produce the activated carbon form. The activation is carried out for a time necessary to obtain the desired pore radius. The pore diameter should be large enough to accommodate the molecules of the hydrocarbon molecules of the bleed emissions.

The activated carbon fibers preferably have a diameter of from about 8 to about 10 microns. A sheet form such as a felt, cloth, or paper may be pleated. Activated carbon fibers derived from novoloid fibers are commercially available from Nippon Kynol and American Kynol (Pleasantville, N.Y.). One commercial example is Kynol activated carbon fiber ACF-1603-15.

In a preferred embodiment, the activated carbon fibers are in the form of chopped fibers and/or fluffy web. In another preferred embodiment, the activated carbon fibers are in the form of a sheet, which may preferably be pleated to reduce pressure drop when refueling vapor flows through the canister. The scrubber may contain more than one form of the second activated carbon fibers to both reduce the pressure drop and minimize the cost of the activated carbon fiber material used.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An evaporative emission control system for a hybrid vehicle, comprising:

a scrubber having an inlet and an outlet;

a pair of opposing electrodes disposed adjacent the respective inlet and outlet;

activated carbon fiber material disposed between said pair of electrodes and configured to adsorb butane and/or pentane isomer vapors in low concentrations in air passing through the scrubber and to form a circuit with the electrodes;

wherein when the circuit is closed, current passes from one of said pair of electrodes through said activated carbon material to the other of said pair of electrodes and provides resistive heating.

2. An evaporative emission control system for a hybrid vehicle according to claim 1, wherein the activated carbon fiber material has an average fiber diameter of from about 8 to about 10 microns and has an average pore diameter of up to about 20 Angstroms.

3. An evaporative emission control system for a hybrid vehicle according to claim 1, wherein the activated carbon fiber material is derived from novoloid fiber material.

4. An evaporative emission control system for a hybrid vehicle according to claim 1, wherein said electrodes comprise copper or steel surfaces in contact with the activated carbon fiber material.

5. An evaporative emission control system for a hybrid vehicle according to claim 1, wherein the activated carbon fiber material comprises activated carbon fibers in a form selected from the group consisting of pleated sheets, chopped fibers, fluffy webs, and combinations thereof.

6. A hybrid vehicle, comprising an internal combustion engine and an electric motor, the hybrid vehicle further comprising:

a fuel tank for storing a volatile fuel for the internal combustion engine;

a primary canister having one or more chambers containing activated carbon granules, said canister having a vapor inlet coupled with the fuel tank, a purge inlet coupled to an air induction inlet for the internal combustion engine, and an air inlet, wherein said one or more chambers are located between the vapor inlet and the air inlet; and a scrubber canister coupled to said air inlet, said scrubber canister being equipped with activated carbon fiber material disposed between opposing conductive metal end plates such that when a closed circuit is formed, current flows between said plates and through said activated carbon fiber material, heating said activated carbon fiber material to a desired temperature via resistive heating;

wherein said activated carbon fiber material has an average fiber diameter of from 8 to 10 microns and pore diameters predominantly from 14 to 22 Angstroms.

7. A hybrid vehicle according to claim 6, wherein the activated carbon fiber material is derived from novoloid fiber material.

8. A hybrid vehicle according to claim 6, wherein the activated carbon fiber material comprises activated carbon fibers in a form selected from the group consisting of pleated sheets, chopped fibers, fluffy webs, and combinations thereof.

9. A method for reducing bleed emissions from an evaporative emission control system for a hybrid vehicle having an internal combustion engine and an electric motor, comprising:

venting the evaporative emission control system to a scrubber containing an activated carbon fiber material disposed between opposing conductive electrodes and forming a circuit, the fiber material being capable of adsorbing butane and/or pentane isomer vapors in low concentrations in air;

closing the circuit and passing an electric current through the activated carbon fiber material:

maintaining the current and heating the activated carbon fiber material containing adsorbed vapors to a desired temperature; and purging vapors from the scrubber for combustion in the internal combustion engine by passing intake air for the internal combustion engine through the heated activated carbon fiber material during operation of the internal combustion engine.

10. A method according to claim 9, wherein the activated carbon fiber material has an average fiber diameter of from about 8 to about 10 microns and has an average pore diameter of up to about 20 Angstroms.

11. A method according to claim 9, wherein the activated carbon fiber material is derived from novoloid fiber material.

12. A method according to claim 9, wherein said heating step is carried out at a time when intake air is not being passed through the activated carbon fiber material.

13. A method according to claim 9, wherein the heating step and the purging step are carried out consecutively and repeated a desired number of times during operation of the internal combustion engine.

* * * * *